US005964038A

United States Patent [19]

DeVito

[11] Patent Number: 5,964,038

[45] Date of Patent: Oct. 12, 1999

[54] DEVICE FOR CUTTING HAIR

[76] Inventor: Pasquale DeVito, 59 Gaffney Rd., Dedham, Mass. 02026

[21] Appl. No.: 08/926,501

[22] Filed: Sep. 10, 1997

Related U.S. Application Data

[60] Provisional application No. 60/051,182, Jun. 28, 1997.

[51] Int. Cl.[6] ..... B26B 13/06

[52] U.S. Cl. ..... 30/226; 30/254

[58] Field of Search ..... 30/244, 226, 254, 30/257, 256; D8/53, 57

[56] References Cited

U.S. PATENT DOCUMENTS

| | | | |
|---|---|---|---|
| 148,854 | 3/1874 | Secor | 30/226 |
| 550,483 | 11/1895 | Carrier | 30/226 |
| 681,972 | 9/1901 | Postlethwait | 30/226 |
| 1,374,819 | 4/1921 | Byer | 30/226 |
| 2,557,553 | 6/1951 | Metzger | 30/254 |
| 2,840,905 | 7/1958 | Geiger | 30/226 |
| 2,852,846 | 9/1958 | Ahlbin | 30/257 |
| 3,325,897 | 6/1967 | Luebkeman | 30/254 |
| 5,501,016 | 3/1996 | Kuribayashi | 30/254 |

FOREIGN PATENT DOCUMENTS

| | | | |
|---|---|---|---|
| 6-190156 | 7/1994 | Japan | 30/254 |

OTHER PUBLICATIONS

A. Eickert Co., Inc. Catelog entitled "Profesonal Scissor and Shear Collection" pp. 1–11 (undated).

*Primary Examiner*—Hwei-Siu Payer
*Attorney, Agent, or Firm*—Steven N. Fox, Esq.

[57] ABSTRACT

Disclosed is a device for use by a hair stylist to cut the hair of a person. In one embodiment, the device comprises first and second blade members each having a handle portion and a blade portion. Each of the blade portions has a cutting edge and a non-cutting edge terminating in a dull or rounded end. By movement of the handles, the blade portions are rotatable from a closed position to an open position. In the closed position, the non-cutting edges of the blade portions are spaced apart to form a first V-shaped gap which may receive but not cut any hair. In the open position, the cutting edges of the blade portions are spaced part and any hair placed therein is cut when the blade portions are moved to the closed position. In both the open and close positions, the cutting edges can never be brought into contact with the stylist's hands and fingers or the skin of the client. With the device of the present invention, a hair stylist has freedom to perform a wide variety of hair cutting techniques without being inhibited by the fear of cutting his/her fingers and/or the skin of the person.

18 Claims, 2 Drawing Sheets

DEVICE FOR CUTTING HAIR

This application claims benefit of Provisional Application Ser. No. 60/051,182, filed Jun. 28, 1997.

FIELD OF THE INVENTION

The present invention relates generally to devices used by hair stylists to cut hair. More specifically, the present invention relates to scissors used by hair stylists to cut hair.

BACKGROUND OF THE INVENTION

A conventional scissor 10 commonly used by professional hair stylists to cut the hair of a person is shown in FIG. 1A (open position) and FIG. 1B (closed position). Such a conventional scissor 10 generally has first and second blade members 12 and 14 rotatably connected to each other about a pivot point 16. Each of the first and second blade members 12 and 14 have a blade portion 18 and a handle portion 20. Each of the blade portions 18 have a cutting edge 22 extending along the entire length of the blade portion 18 and terminating at a sharp end point 24. When the scissor 10 is closed by moving the handles 20 of blade members 12 and 14 together, the blade portions 18 and cutting edge 22 are completely closed and overlap each other and cut any hair which has been placed therein. Scissors of the type exemplified by FIG. 1 have numerous drawbacks which restrict the ability of the hair stylist to provide a clean and stylish hair cut. In that the cutting edges 22 of the scissor 10 extend along the entire length of the blade portions 18, the hair stylist must be careful only to allow that portion of the hair which is to be cut to enter the space between the blade portions 18 of the blade members 12 and 14. This restricts the ability of the hair stylist to perform a wide variety of hair cutting techniques such as interior edging, point cutting, slide cutting, notching, chipping, layering, and sizing. In that the blade portions 18 terminate in a sharp end point 24, the hair stylist frequently cuts various portions of his/her hands and fingers and the skin of the person during various hair cutting techniques thereby inhibiting the stylist from aggressively performing such hair cutting techniques.

SUMMARY OF THE PRESENT INVENTION

One object of the present invention is to develop a device for cutting the hair of a person that can be used by a hair stylist to comfortably and quickly perform a wide variety of hair cutting techniques.

Another object of the present invention is develop a device for cutting the hair of a person that can be safely used by a hair stylist to avoid injury to the hands and fingers of the stylist and the scalp or other skin area of the person.

In one embodiment, the device comprises first and second blade members each having a handle portion and a blade portion. Each of the blade portions has a cutting edge and a non-cutting edge terminating in a dull end. By movement of the handles, the blade portions are rotatable from a closed position to an open position. In the closed position, the non-cutting edges of the blade portions are spaced apart to form a first V-shaped gap which may receive but will not cut any hair. In the open position, the cutting edges of the blade portions are spaced part and any hair placed therein is cut when the blade portions are moved to the closed position. In both the open and close positions, the cutting edges cannot be brought into contact with the stylist's hands and fingers or the skin of the person. With the device of the present invention, a hair stylist has freedom and confidence to perform a wide variety of hair cutting techniques without being inhibited by the fear of cutting his/her fingers and/or the skin of the person.

BRIEF DESCRIPTION OF THE DRAWINGS

The following detailed description of the present invention will be better understood with reference to the accompanying drawings in which.

DETAILED DESCRIPTION OF THE PREFERRED EMBODIMENTS

Figure 1A:
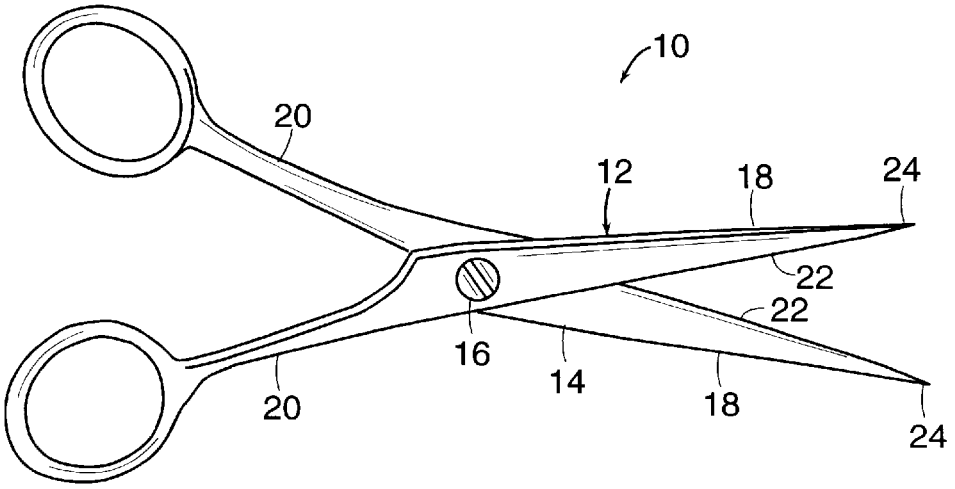
FIG. 1A (PRIOR ART)
FIG. 1A is a plan view of a conventional scissor in the open position.
Figure 1B:
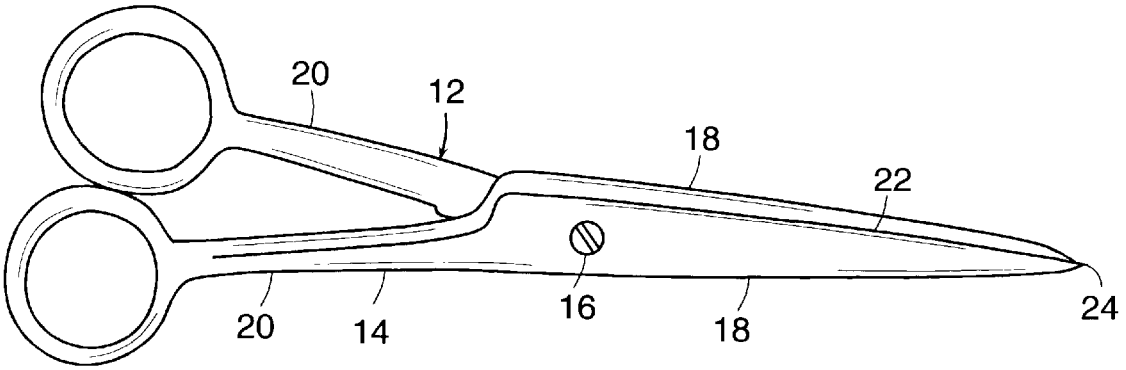
FIG. 1B (PRIOR ART)
FIG. 1B is plan view of a conventional scissor in the closed position.
Figure 2:
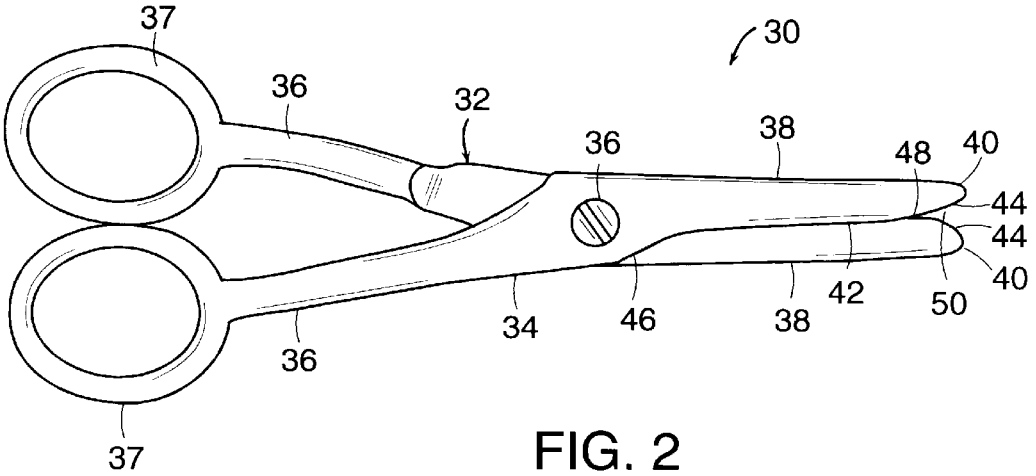
FIG. 2 is a plan view of a first embodiment of the scissor of the present invention in a closed position.

Referring to FIG. 2, where a first embodiment of the device 30 of the present invention is shown (in a "closed position") generally comprising a first blade member 32 rotatably connected to a second blade member 34 about a pivot point 35. The pivot point 35 may consist any type of conventional fastener such as a joint screw extending through openings (not shown) provided in the first and second blade members 32 and 34. Each of the first and second blade members 32 and 34 generally comprise a handle portion 36 having a handle member 37 adapted to be grasped by the hair stylist and a blade portion 38 terminating in a dull end portion 40. Each of the blade portions 38 comprise a cutting edge 42 and a non-cutting edge 44. The cutting edge 42 begins at a point 46 and terminates at a point 48 immediately adjacent to the non-cutting edge 44. The non-cutting edge 44 begins at the point 48 and terminates at the dull or rounded end 40. The non-cutting edges 44 are designed to be dull so as not to cut any hair or cause injury to the hand and fingers of the stylist or the skin of the client. In the preferred embodiment the non-cutting edges 44 and the end portion 40 are curved or rounded. By movement of the handles 36, the blade portions 38 are rotatable from a "closed" position (shown in FIG. 2) to an open position (not shown). In the closed position (FIG. 2), the non-cutting edges 44 of the blade portions 38 are spaced apart to form a first V-shaped gap 50 which may receive but not cut any hair. In the "open" position (not shown), the cutting edges 42 of the blade portions 38 are spaced part and any hair placed therein is cut when the blade portions 38 are moved to the closed position. Because the cutting edges 42 are interior to that of the non-cutting edges 44 and end portion 40, in both the open and closed positions, it is difficult if not impossible for the cutting edges 42 to come in contact with the stylist's hands and fingers or the skin of the person. The shape of the first and second blade members 32 and 34 and the curvature of the non-cutting edges 44 may be varied so that closure of the handles 37 creates the desired size of the first V-shaped gap 50 in the "closed" position. With the device 30, a hair stylist has the freedom to perform a variety of cutting techniques without the fear of cutting his/her fingers and/or the skin of the person.

Figure 3:
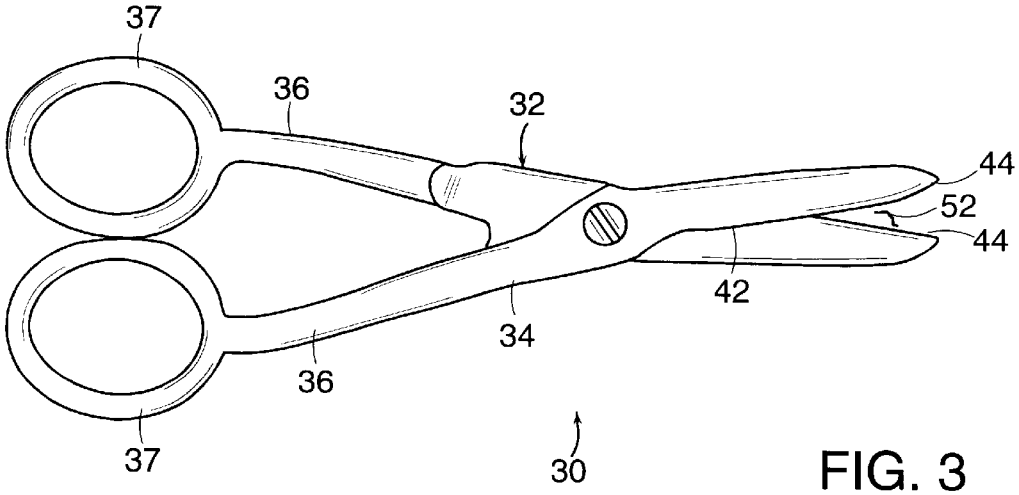
FIG. 3 is a plan view of a second embodiment of the scissor of the present invention in a closed position.

Referring to FIG. 3 where a second embodiment of the device 30 of the present invention is shown. The only difference between the device 30 of the first embodiment (FIG. 21) and the device 30 of the second embodiment (FIG. 3), is that the length of the cutting edges 42 is shortened and the length of the non-cutting edges 44 are increased and shaped so as to create a second V-shaped gap 52 which is larger than the first V-shaped gap 50 of the first embodiment. The device 30 of the second embodiment is desirable when the hair stylist wants to allow a larger amount of hair to enter the V-shaped gap 52 prior to opening of the device 30 and initiation of a cutting procedure.

Figure 4:
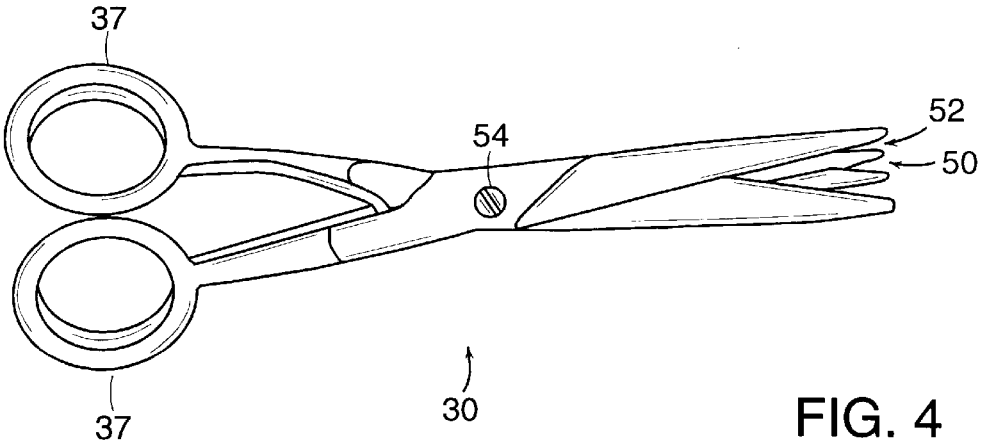
FIG. 4 is a plan view of a third embodiment of the scissor of the present invention in a closed position.

Referring to FIG. 4 wherein a third embodiment of the device 30 of the present invention comprises the device 30 of the first embodiment (FIG. 2) joined with the device 30 of the second embodiment (FIG. 3) by a common screw or fastener 54 to thereby create a single device 30 having two sets of blade members having blade portion with different lengths of cutting edges 42 and non-cutting edges 44 and a V-shaped gaps 50 which is smaller than the V-shaped gap 52.

Although the various embodiments of the device 30 of the present invention have been described with reference to cutting the hair of a person, the device 30 can be used to cut the hair of various animals such as dogs or cats. The materials used in connection with the various embodiments of device 30 may be made from any suitable material to accomplish the desired cutting task such as steel, stainless steel, plastic, or reinforced plastic.

The foregoing description is intended primarily for purposes of illustration. This invention may be embodied in other forms or carried out in other ways without departing from the spirit or scope of the invention. Modifications and variations still falling within the spirit or the scope of the invention will be readily apparent to those of skill in the art.

What is claimed is:

1. A device for cutting the hair of a person comprising:

a first blade member having a first handle portion and a first blade portion, said first blade portion having a first cutting edge and a first non-cutting edge extending from said first cutting edge and terminated at a free end of said first blade portion;

a second blade member having a second handle portion and a second blade portion, said second blade portion having a second cutting edge and a second non-cutting edge extending from said second cutting edge and terminated at a free end of said second blade portion;

said first blade member being rotatably connected to said second blade member between a first closed position and a first open position;

said first closed position being where said first and second non-cutting edges are spaced apart to form a first V-shaped gap and said first and second cutting edges are substantially closed;

said first open position being where said first and second cutting edges are spaced apart to receive the hair; and said first non-cutting edge facing said second non-cutting edge in said first open position.

2. The device of claim 1, wherein said first and second non-cutting edges are dull.

3. The device of claim 2, wherein said first and second blade members are shaped such that in said first closed position said first and second non-cutting edges form said first V-shaped gap and in said first open position said first and second cutting edges are spaced apart to receive the hair.

4. The device of claim 3, wherein said first and second handle portions are connected to said first and second blade portions, respectively.

5. The device of claim 1 further comprising a third blade member having a third handle portion and a third blade portion, said third blade portion having a third cutting edge and a third non-cutting edge extending from said third cutting edge and terminated at a free end of said third blade portion.

6. The device of claim 5 further comprising a fourth blade member having a fourth handle portion and a fourth blade portion, said fourth blade portion having a fourth cutting edge and a fourth non-cutting edge extending from said fourth cutting edge and terminated at a free end of said fourth blade portion.

7. The device of claim 6, wherein said third blade member is rotatably connected to said fourth blade member between a second closed position and a second open position.

8. The device of claim 7, wherein said second closed position is where said third and fourth non-cutting edges are spaced apart to form a second V-shaped gap and said third and fourth cutting edges are substantially closed.

9. The device of claim 8, wherein said second open position is where said third and fourth cutting edges are spaced apart to receive the hair.

10. The device of claim 9, wherein said first V-shaped gap is smaller than said second V-shaped gap.

11. The device of claim 10, wherein said third non-cutting edge faces said fourth non-cutting edge in said second open position.

12. The device of claim 11, wherein said third and fourth non-cutting edges are dull.

13. The device of claim 12, wherein said third and fourth blade members are shaped such that in said second closed position said third and fourth non-cutting edges form said second V-shaped gap and in said second open position said third and fourth cutting edges are spaced apart to receive the hair.

14. The device of claim 13, wherein said third and fourth handle portions are connected to said third and fourth blade portions, respectively.

15. The device of claim 14, wherein said first and second blade members are connected to said third and fourth blade members.

16. The device of claim 15, wherein said first blade member is rotatably connected to said second blade member about a pivot member.

17. The device of claim 16, wherein said third blade member is rotatably connected to said fourth blade member about said pivot member.

18. The device of claim 17, wherein said pivot member is a screw member.

* * * * *